US005216812A

United States Patent [19]

Lyons

[11] Patent Number: 5,216,812

[45] Date of Patent: Jun. 8, 1993

[54] SHELLFISH OPENING KNIFE UTENSIL

[76] Inventor: David E. Lyons, 10310 SW. 103 Ct., Miami, Fla. 33176

[21] Appl. No.: 757,730

[22] Filed: Sep. 11, 1991

[51] Int. Cl.[5] ..... B26B 17/02; B26B 9/00; B26B 9/02

[52] U.S. Cl. ..... 30/120.1; 30/346; 30/355

[58] Field of Search ..... 30/120.1, 346, 352, 30/353, 357, 355; 452/11, 12, 13, 14, 15, 16, 17, 18

[56] References Cited

U.S. PATENT DOCUMENTS 98,102 2/1869 Pattberger ..... 452/17
D. 171,522 2/1954 Zimmerman ..... 30/346
527,175 10/1894 Hurd ..... 30/346
829,353 8/1906 Rand ..... 452/17

FOREIGN PATENT DOCUMENTS 532191 1/1958 Belgium ..... 30/355
7907718 10/1980 France ..... 30/120.1

*Primary Examiner*—Frank T. Yost
*Assistant Examiner*—Sr. Heyrana
*Attorney, Agent, or Firm*—Louis E. Marn

[57] ABSTRACT

A knife utensil for separating shell members of a mollusk comprised of a bar member having a blade portion mounted to retaining members forming a handle and formed with an arcuate upper honed edge and a concave-shaped lower honed edge defining a point at a free end disposed between a centerline of a bar member and a point at which the upper surface meets the retaining members.

7 Claims, 1 Drawing Sheet

SHELLFISH OPENING KNIFE UTENSIL

BACKGROUND OF THE INVENTION

(1) FIELD OF INVENTION

This invention relates to utensils for separating cooperating shells member of bivalve mollusks, and more particularly to a knife utensil for forcibly separating the shell members of oysters to expose the meat portion therein.

(2) DESCRIPTION OF THE PRIOR ART

The efficacious separation of the shell members of bivalve mollusks has been a long sought desire from the time whereat the meat portion of bivalve mollusks were found to be of epicurian delight. Solutions have included utensils which usually separate such shell member but also may be used to sever the muscle connected to the shell members with subsequent meat removal. For example, in U.S. Pat. No. 3,991,466 to Smith, there is disclosed a dual purpose spoon and oyster knife utensil comprised of a handle having a blade shaped with curved spoon section serrated at opposed sides thereof with a knife section projecting therefrom along an axis of the blade. While capable of achieving a desired result, the knife portion suffers from the lack of efficacion penetration between the shell members as well as to provide adequate forces for facile separation of the shell members after penetration.

OBJECTS OF THE PRESENT INVENTION

An object of the present invention is to provide an improved knife utensil for penetrating and forcibly separating the shell members of bivalve mollusks.

Another object of the present invention, is to provide an improved knife utensil for penetrating and forcibly separating the shell members of bivalve mollusks, particularly oysters.

A still further object of the present invention is to provide an improved knife utensil for penetrating and forcibly separating the shell members of bivalve mollusks, particularly oysters, having non-linear cooperating closing surfaces of each shell member.

Still another object of the present invention is to provide an improved knife utensil substantially reducing time and effort for separating shell members of bivalve mollusks.

SUMMARY OF THE INVENTION

These and other objects of the present invention are achieved by a knife utensil for separating shell members of a mollusk comprised of a bar member having a blade portion mounted to retaining members forming a handle and formed with an arcuate upper honed edge and a concave-shaped lower honed edge defining a point at a free end disposed between a centerline of the bar member and a point at which the upper surface meets the retaining members.

BRIEF DESCRIPTION OF THE DRAWING

Further objects and advantages of the present invention will become apparent from the following detail description thereof when taken with the accompanying drawing wherein.

DETAIL DESCRIPTION OF THE DRAWINGS

Figure 1:
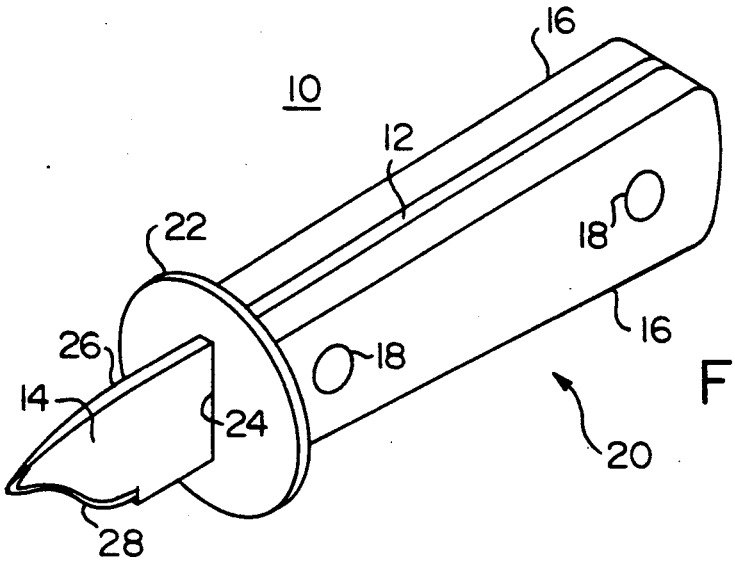
FIG. 1 is an isometric view of the knife utensil of the present invention.
Figure 2:
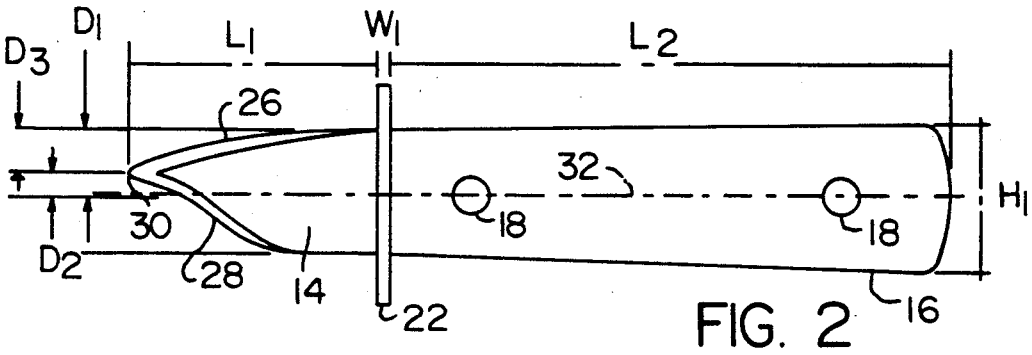
FIG. 2 is a side elevational view of the knife utensil of the present invention.
Figure 3:
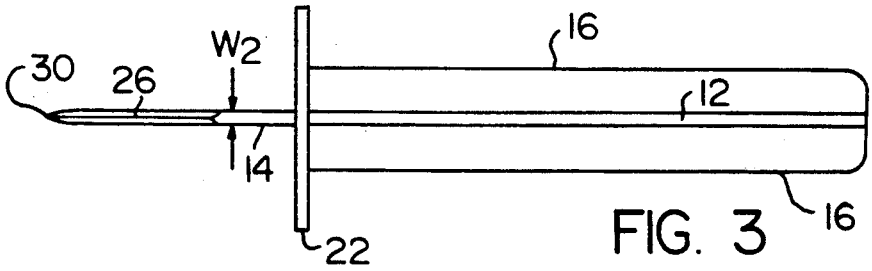
FIG. 3 is a top view.
Figure 4:
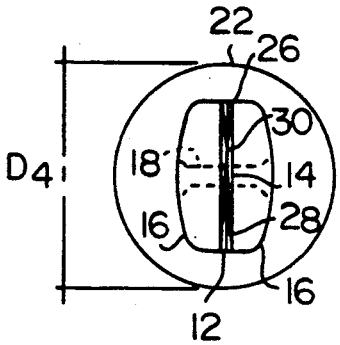
FIG. 4 is an end view.

Referring now to the drawings, there is illustrated a knife utensil of the present invention, generally indicated as 10, comprised of an elongated metallic bar member 12 having a blade portion 14 and mounted between retaining members 16, such as by rivets 18, forming a handle, generally indicated as 20. It will be understood that the handle may be formed of one piece construction of a plastic material. The bar member is preferably formed of a metallic material, such as stainless steel, high carbon steel and the like. A circularly-shaped metallic shield 22 including a slot 24 member is disposed over the blade portion 14 and mounted to the retaining members 16 to protect the hand of the user from inadvertent contact with shell members, as more fully hereinafter discussed. The distance $L_1$ of blade portion 14 referring particularly to FIG. 2, is less than the distance $L_2$ of the handle member, and is preferably dimensioned wherein $L_1 < L_2/2$.

The blade portion 14 is formed with a concave or arcuate upper honed edge 26 and a generally concave lower honed edge 28 terminating in a point 30 at a free end opposite the shield member 22 and above the centerline 32 of the knife utensil 10. In a particularly preferred form of the invention, D2 is less than $D_3$ wherein $D_1 = D_2 + D_3$ where $D_1$ is the distance between the centerline 32 and the point where upper edge 26 meets the shield 22, $D_2$ is the distance between the centerline 32 and the point 30 and $D_3$ is the distance between the point 30 and where the upper edge 26 meets the shield 22.

In operation, the point 30 is caused to be inserted between the cooperating surfaces of the shell members of the mollusk (not shown) whereby the point 30 coupled with the cooperating configuration of the upper surface 26 with the lower surface 28 permits significant incipient penetration. The point 20 and cooperating configuration of the edges 26 and 28 permit the development of a substantial rotational force about the centerline of the point 30 of the portion member 14 after initial penetration of the point 30, preferable to about ¼ to ½ inches between the cooperating surfaces of the shell members of the mollusks to effectively counter the clamping muscle forces of the mollusk. After separation of the shell members, the shape of the lower edge 28 facilitates severance of the muscles of the mollusks from the shell members.

While the invention has been described in connection with an exemplary embodiment thereof, it will be understood that many modifications will be apparent to those of ordinary skill in the art; and that this application is intended to cover any adaptations of variations thereof. Therefore, it is manifestly intended that this invention be only limited by the claims and the equivalents thereof.

What is claimed is:

1. As knife utensil for separating shell members of a mollusk, which comprises:

metallic bar member having a blade portion and mounted to retaining member forming a handle of said knife utensil, said blade portion armed with an arcuate upper honed edge and a concave lower honed edge extending rom said handle portion to form a free end point disposed between a center line of said bar member and a meeting point of contact between said bar member with said retaining member, wherein $D_2$ is the distance between the said end point and the centerline of the said bar, $D_3$ is the distance between the said end point and the said arcuate upper honed edge of the bar and $D_1$ is the distance between the centerline of said bar and the said arcuate upper honed edge of the said bar, wherein $D_2$ is less than $D_3$ and wherein $D_2+D_3=D_1$.

2. The knife utensil as defined in claim 1 and further including a shield member mounted to an disposed transversely to said bar member and said retaining member.

3. The knife utensil as defined in claim 2 wherein said shield member is circularly-shaped.

4. The knife utensil as defined in claim 1 and further including a shield member mounted to and disposed transversely to said bar member and said retaining member.

5. The knife utensil as defined in claim 1 wherein said shield member is circularly-shaped.

6. The knife utensil as defined in claim 1 wherein a length of said knife utensil equals the length $L_1$ of said blade portion and the length of $L_2$ of said handle portion wherein $L_1 > L_2/2$.

7. The knife utensil as defined in claim 1 wherein said retaining member is form of a plastic material.

* * * * *